US006863193B2

(12) United States Patent
Grossenbacher

(10) Patent No.: US 6,863,193 B2
(45) Date of Patent: Mar. 8, 2005

(54) CLOSING CAP FOR TWO-CHAMBER CONTAINERS

(75) Inventor: Pierre Grossenbacher, Clarens (CH)

(73) Assignee: Aisapack Holding SA, Vouvry (CH)

( * ) Notice: Subject to any disclaimer, the term of this patent is extended or adjusted under 35 U.S.C. 154(b) by 36 days.

(21) Appl. No.: 10/416,970

(22) PCT Filed: Nov. 19, 2001

(86) PCT No.: PCT/EP01/13361

§ 371 (c)(1),
(2), (4) Date: May 15, 2003

(87) PCT Pub. No.: WO02/42170

PCT Pub. Date: May 30, 2002

(65) Prior Publication Data

US 2004/0040984 A1 Mar. 4, 2004

(30) Foreign Application Priority Data

Nov. 21, 2000 (DE) ..... 100 57 515

(51) Int. Cl.[7] ..... B67D 3/00

(52) U.S. Cl. ..... 222/142.7; 222/482; 222/546; 222/556

(58) Field of Search ..... 222/94, 129, 142.7, 222/481, 482, 483, 545, 546, 556

(56) References Cited

U.S. PATENT DOCUMENTS

| | | | | | |
|---|---|---|---|---|---|
| 1,172,155 | A | * | 2/1916 | Mayer et al. | 222/142.7 |
| 1,270,418 | A | * | 6/1918 | Kaempf | 222/142.7 |
| 3,729,553 | A | | 4/1973 | Gold et al. | 424/44 |
| 4,369,901 | A | * | 1/1983 | Hidding | 222/480 |
| 4,723,693 | A | * | 2/1988 | DeCoster | 222/483 |
| 5,706,981 | A | * | 1/1998 | Nobakht | 222/132 |
| 5,765,725 | A | | 6/1998 | Matt | 222/129 |
| 5,954,231 | A | | 9/1999 | Durliat et al. | 222/1 |
| 5,957,336 | A | * | 9/1999 | Radassao et al. | 222/129 |
| 6,079,586 | A | | 6/2000 | Hanneman | 220/526 |

FOREIGN PATENT DOCUMENTS

| | | |
|---|---|---|
| DE | 19722417 | 10/1998 |
| FR | 2623170 | 5/1989 |

* cited by examiner

*Primary Examiner*—Joseph A. Kaufman
(74) *Attorney, Agent, or Firm*—Collard & Roe, P.C.

(57) ABSTRACT

A closing cap (1) for two-chamber containers (2), which can be connected to an outlet opening (3) of the container (2). The container (2) is divided by a separating element (4), which extends up to outlet opening (3), so that the contents of the first chamber (5) are supplied separately from the contents of the second chamber (6) to the outlet opening (3). According to the invention, a detent connection is provided for joining the closing cap (1) to the container (2), whereby a separating wall (12) divides the closing cap (1) into two separate areas. A separately closeable withdrawal opening (8, 8') is arranged in each area, and the separating wall (12) interacts with the separating element (4) as to connect each of the chambers (5,6) of the container (2) only to the area of the closing cap (1), in which the assigned withdrawal opening (8, 8') is located.

12 Claims, 1 Drawing Sheet

CLOSING CAP FOR TWO-CHAMBER CONTAINERS

CROSS REFERENCE TO RELATED APPLICATIONS

Applicant claims priority under 35 U.S.C. §119 of GERMAN Application No. 100 57 515.3 filed on 21 Nov. 2000. Applicants also claim priority under 35 U.S.C. §365 of PCT/EP01/13361 filed on 19 Nov. 2001. The international application under PCT article 21 (2) was not published in English.

BACKGROUND OF THE INVENTION

1. Field of the Invention

The invention relates to a closure cap for dual chamber vessels.

2. Prior Art

Tubes and other containers comprising two or more separate chambers for storing and dispensing in metered doses the contents of the chambers are known. In particular, in the field of cosmetics preparations are developed to an increasing extent consisting of components with are non-compatible with one another and which are mixed only when used.

For the latter, dual chamber tubes were proposed, e.g. in DE 197 22 417 C1, in which the tube body comprises a partition fixed along two longitudinal lines, which are symmetrical about the central axis. In order to attain a sufficiently large charging aperture, the partition is in this case additionally fixed at least in the region of the one end section of the tube body at at least one location in such a manner that the partition in the rounded cross-section of the tube body rectilinearly subdivides the latter.

U.S. Pat. No. 3,729,553 discloses a dual chamber vessel for a foaming composition, the solutions stored separately in the two chambers being mixed when being withdrawn together and being foamed in the process.

U.S. Pat. No. 5,765,725 describes a compressible dual chamber vessel comprising a closure through which the contents of one chamber may be withdrawn separately from the contents of the other chamber. For this purpose withdrawal apertures are provided in the closure comprising separate covers.

None of the prior art configurations permits both the simultaneous as well as the separate withdrawal of the contents of the different chambers. In addition, the known solutions are ill suited for those containers in which the partition element of the vessel chambers is not arranged symmetrically in relation to the withdrawal apertures.

SUMMARY OF THE INVENTION

It is the object of the present invention to provide a closure cap for multi-chamber vessels, which is more flexible with regard to its field of application and which, in particular, permits both a separate as well as a joint withdrawal of the contents of the different chambers.

This object is attained by a closure cap for a dual chamber vessel having the features disclosed Advantageous embodiments are also disclosed.

The closure cap according to the invention is particularly suited for preparations which are to be used separately from one another, but in close relationship in a timewise or functional sense. In this context one could mention, for example, shampoo and conditioner for hair care or day and night care creams.

In the case of a closure cap for dual chamber vessels, connectable to a discharge aperture of the vessel, the vessel being subdivided by a partition element extending right into the discharge aperture such that the contents of the first chamber is fed to the discharge aperture separately from the contents of the second chamber and each chamber being associated with a separately closable withdrawal aperture, the cap according to the invention consists of a connecting member for establishing a connection to the vessel and a withdrawal member with which the withdrawal apertures are associated, both members being interconnected by snap elements.

In this manner the contents of the first chamber of the vessel may be withdrawn separately from or simultaneously with the contents of the second chamber. The closure cap according to the invention is suited in particular for tubes and even permits to be adapted to withdrawal apertures which are arranged in an asymmetrical manner in relation to the partition element. The snap connection ensures simple and, consequently, cost-effective production. In addition, the withdrawal member may further be so designed, should this be desired, that the contents of the different chambers are mixed during withdrawal, making a re-adjustment of the vessel and the connecting member redundant.

For connecting the closure cap to the vessel a snap connection is preferred as well.

The closure cap comprises means through which the contents of one chamber may be fed separately from the contents of the other chamber to the associated withdrawal aperture. Advantageously, a partition is provided between the withdrawal apertures of the chambers in the interior of the closure cap, subdividing the closure cap into two separate regions, a withdrawal aperture being provided in each region. The partition is in this context connectable to the partition element in such a manner that mixing of the chamber contents does not take place.

The partition may preferably be receivable in a matching groove of the partition element at the discharge aperture of the vessel. Alternatively, the partition may likewise comprise a groove, in which the partition element may be received in formfitting relationship.

In the closure cap according to the invention the withdrawal apertures are preferably arranged in spaced apart relationship, for example arranged on opposite sides in an overall round or oval closure cap.

The connecting member of the closure cap is preferred to comprise sections adapted to the configuration of the discharge aperture, through which sections the contents of the chambers is fed to the separate regions within the closure cap. The discharge aperture of the vessel may, for example, comprise two semicircular apertures, formed by the partition element within the vessel. Consequently, the sections of the closure cap are likewise correspondingly semicircular and introducible into the apertures in close fitting relationship. The contents of the chambers is thus fed to the respective region within the closure cap and, as a result, to the associated withdrawal aperture. In the event of an asymmetrical arrangement of the partition element in relation to the withdrawal apertures, e.g. when turned by 90° C., the sections of the closure cap are designed correspondingly in quarter circles thus ensuring that the contents of one chamber is accurately fed to one withdrawal aperture.

In a particularly preferred embodiment the withdrawal apertures are each closable by a snap closure known per se. A closure of this type for a vessel comprising a single chamber is described, for example, in DE 41 23 733.

The connecting member of the closure cap according to the invention is connected to the discharge aperture of the vessel in a manner known per se. It may, for example, be screwed on by way of a thread moulded onto the vessel. Preferably, the closure cap is snap-connectable to the vessel. For this purpose an annular projection may be moulded on, for example, in the region of the discharge aperture overlapped by the closure cap. In comparison to a screw connection, this snap connection proves to be particularly simple and cost-effective. For further position fixing of the closure cap, the vessel may comprise a shoulder against which the lower edge of the closure cap fits closely.

Plastics materials are particularly suitable to manufacture the closure cap according to the invention.

BRIEF DESCRIPTION OF THE DRAWING

In what follows the invention is to be elucidated in more detail by way of an example with reference to the drawing.

The drawing shows a schematic longitudinal section through a closure cap for a dual chamber tube according to the invention.

DETAILED DESCRIPTION OF THE INVENTION

Figure 1:
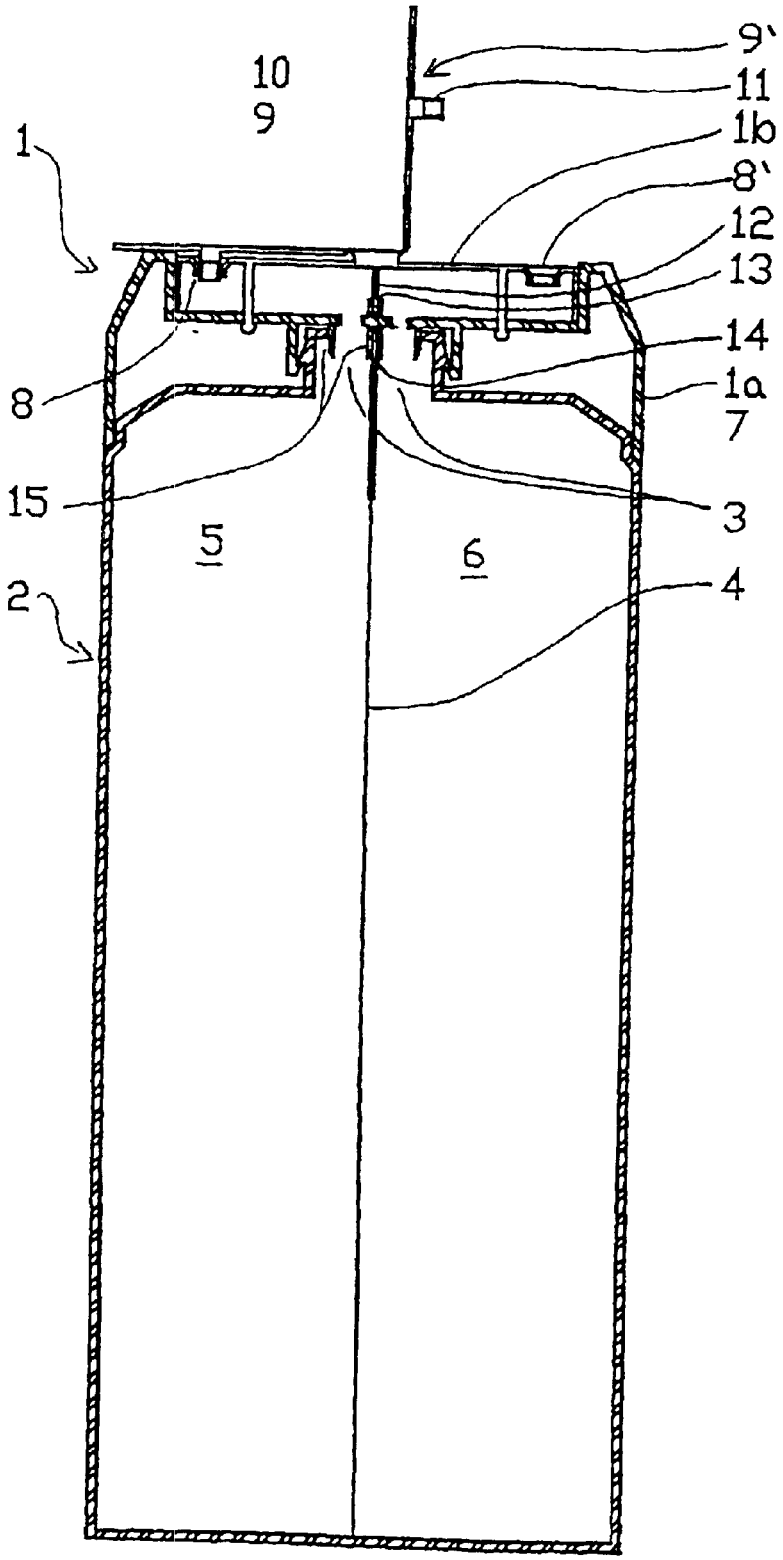

A closure cap 1 is shown, closing the discharge aperture 3 of a dual chamber tube 2. The tube 2 is subdivided into two chambers 5 and 6 by a partition foil 4 serving as a partition element. The contents of the chambers 5, 6, not shown, is fed separately to the discharge aperture 3. The material strength of the partition foil 4 is reinforced in the region of the discharge aperture 3 to such an extent that the partition element is dimensionally stable. At the discharge aperture 3 of the tube 2 a peripheral annular projection 7 is provided, overlapped by the closure cap 1 by way of a matching projection, thus fixing the closure cap to the tube 2.

The closure cap 1 is designed in two parts. A connecting member 1*a* is snap-connected to the tube 2 by way of the projection 7. The withdrawal apertures 8, 8' are arranged in a withdrawal member 1*b*. As far as the withdrawal member 1*b* is concerned, it is snap-connected to the connecting member 1*a*. In order to improve dimensional stability, the lower edge of the connecting member 1*a* fits closely against a shoulder of the vessel.

For feeding the contents of the chambers 5, 6 separately to the associated withdrawal apertures 8, 8', a partition 12 is provided in the withdrawal member 1*b*. The partition 12 is accommodated in a groove 13 in the connecting member 1*a*. A further groove 14 on the connecting member 1*a* co-acts with the partition foil 4 in such a manner that the contents of the chambers 5, 6 is fed without mixing to the respective withdrawal aperture 8, 8'.

The two-piece closure cap according to the invention permits without any problem in a vessel, the partition element of which is not arranged parallel to the partition of the closure cap, to withdraw the contents of the chambers without mixing. This chamfer of the partition element of the vessel in relation to the partition may, for example, be advantageous with regard to manufacturing techniques. The connecting member 1*a* ensures in the process the required connection between the individual chambers of the vessel 2 and the associated withdrawal apertures 8, 8' in the withdrawal member 1*b*.

The connecting member 1*a* further comprises semicircular sections 15, which are accommodated in the discharge aperture 3 in form-fitting relationship. Through these sections 15 the contents of the chambers 5, 6 reaches that region of the closure cap 1 with which the respective withdrawal aperture 8, 8' is associated.

Each withdrawal aperture 8, 8' is associated with exactly one chamber 5, 6 of the tube 2, so that the contents of chamber 5 may be withdrawn from the withdrawal aperture 8 and the contents of chamber 6 from the withdrawal aperture 8'. According to the invention, each withdrawal aperture 8, 8' is closable for this purpose by a snap closure 9, 9'. The two snap closures 9, 9' are structured identically, the snap closure 9 being shown in its closed state and the snap closure 9' in its open state.

Each of the snap closures 9, 9' is formed by a plate-like cover 10 connected to the withdrawal member 1*b* by a thin film hinge and serving as an actuating element, and by a projection 11 so dimensioned and arranged that the withdrawal aperture 8, 8' is closable by the projection 11. The withdrawal apertures 8, 8' are formed by recesses in the withdrawal member 1*b*, comprising on the side facing the snap closures 9, 9' a chamfer for guiding the projection 11 during closing. The cover 10 projects laterally beyond the closure cap 1 in order to facilitate opening the snap closure 9, 9'. For this purpose the wall of the closure cap 1 recedes slightly in the region of the snap closures 9, 9'.

The closure cap according to the invention permits separate withdrawal of the contents of the two tube chambers. When opening both snap closures, simultaneous withdrawal is likewise possible. The selected connections by snap means result in simple and cost-effective production. Even conventional dual chamber tubes may be provided with the closure cap according to the invention without complex adaptation. It is understood that an analogous use of the closure caps according to the invention is also possible for vessels with more than two chambers, provided appropriate spatial conditions exist. For that purpose a third withdrawal aperture with closure would have to be provided. The application of other closing principles known per se instead of the preferred snap closure, for example, slidable closures, is likewise well conceivable.

Moreover, the two-part closure cap may also be made of different types of plastics or materials and/or materials of different colours, clearly increasing, therefore, the aesthetic design possibilities.

What is claimed is:

1. A closure cap connectable to a discharge aperture of a dual-chamber vessel having a partition element subdividing the dual-chamber vessel into a first chamber and a second chamber and extending into the discharge aperture such that a content of the first chamber is fed to the discharge aperture separately from a content of the second chamber, the closure cap comprising:

(a) a snap connection for connecting the closure cap to the dual-chamber vessel;

(b) a partition, partitioning the closure cap into a first separate region and a second separate region, said partition receivable in a matching groove of the partition element at the discharge aperture of the dual chamber vessel in a form-fitting relationship;

(c) a first separately closable withdrawal aperture disposed in said first separate region and a second separately closable withdrawal aperture disposed in said second separate region;

(d) a connecting member for establishing a connection between the closure cap and the dual-chamber vessel; and (e) a withdrawal member associated with said first separately closable withdrawal aperture and said second separately closable withdrawal aperture, said withdrawal member being snap-connectable to said connecting member;

wherein said partition interacts with the partition element such that the first chamber of the dual-chamber vessel communicates only with said first separate region of the closure cap and said first separately closable withdrawal aperture and the second chamber of the dual-chamber vessel communicates only with said second separate region of the closure cap and said second separately closable withdrawal aperture.

2. The closure cap according to claim 1, wherein said first and second separately closable withdrawal apertures are in spaced apart relationship.

3. The closure cap according to claim 1, further comprising sections adapted to a configuration of the discharge aperture through which sections the contents of the first and second chambers are fed to said first and second separate regions within the closure cap.

4. The closure cap according to claim 1, wherein said partition further comprising a groove in which the partition element can be received in form-fitting relationship.

5. The closure cap according the claim 1, further comprising an annular projection provided at the discharge aperture of the dual-chamber vessel, overlapped by the closure cap, and serving as a snap connection.

6. The closure cap according to claim 1, further comprising an outer lower edge which fits closely against a shoulder of the vessel.

7. The closure cap according the claim 1, further comprising snap closures for closing said first and second withdrawal aperture.

8. The closure cap according to claim 7, wherein said snap closures are formed by a projection formed on an actuating element, hinged to the closure cap, said projection being so dimensioned and arranged that said first and second withdrawal aperture can be closed by said projection.

9. The closure cap according to claim 8, wherein said first and second withdrawal aperture are circular and said projection of cylindrical configuration, a diameter of said projection in one section thereof being slightly larger than a diameter of said first and second withdrawal aperture.

10. The closure cap according to claim 8, wherein said first and second aperture on a side which faces said projection includes a chamfer for guiding said projection during closing of the dual-chamber vessel.

11. The closure cap according to claim 7, wherein the closure cap is made of plastics.

12. A closure cap connectable to a discharge aperture of a dual-chamber vessel having a partition element subdividing the dual-chamber vessel into a first chamber and a second chamber and extending into the discharge aperture such that a content of the first chamber is fed to the discharge aperture separately from a content of the second chamber, the closure cap comprising:

(a) a snap connection for connecting the closure cap to the dual-chamber vessel;

(b) a partition, partitioning the closure cap into a first separate region and a second separate region;

(c) a first separately closable withdrawal aperture disposed in said first separate region and a second separately closable withdrawal aperture disposed in said second separate region;

(d) a connecting member for establishing a connection between the closure cap and the dual-chamber vessel; said connecting member comprising:

(i) a first groove disposed on an underside of said connecting member facing the dual-chambered vessel for accommodating the partition element; and (ii) a second groove disposed on an upper side of said connecting member for accommodating said partition;

(e) a withdrawal member associated with said first separately closable withdrawal aperture and said second separately closable withdrawal aperture, said withdrawal member being snap-connectable to said connecting member;

wherein said partition interacts with the partition element such that the first chamber of the dual-chamber vessel communicates only with said first separate region of the closure cap and said first separately closable withdrawal aperture and the second chamber of the dual-chamber vessel communicates only with said second separate region of the closure cap and said second separately closable withdrawal aperture.

* * * * *